US005293940A

United States Patent [19]

Hromas et al.

[11] Patent Number: 5,293,940

[45] Date of Patent: Mar. 15, 1994

[54] AUTOMATIC TUBING RELEASE

[75] Inventors: Joe C. Hromas, Sugar Land; Antoni K. L. Miszewski, Missouri City; Klaus B. Huber, Sugar Land, all of Tex.

[73] Assignee: Schlumberger Technology Corporation, Houston, Tex.

[21] Appl. No.: 32,817

[22] Filed: Mar. 16, 1993

Related U.S. Application Data

[63] Continuation of Ser. No. 858,400, Mar. 26, 1992, abandoned.

[51] Int. Cl.[5] ..... E21B 43/116

[52] U.S. Cl. ..... 166/297; 166/55.1; 166/376; 166/377

[58] Field of Search ..... 166/377, 376, 297, 299, 166/55.1, 63; 137/68.2, 70, 71; 175/4.52, 4.54

[56] References Cited

U.S. PATENT DOCUMENTS

| | | | |
|---|---|---|---|
| 2,674,313 | 4/1954 | Chambers | 166/63 |
| 2,725,942 | 12/1955 | McCullough | 166/299 X |
| 2,904,112 | 9/1959 | Wiley | 166/63 |
| 3,057,295 | 10/1962 | Christopher | 166/55 X |
| 3,208,355 | 9/1965 | Baker et al. | 137/70 X |
| 3,589,442 | 6/1971 | Kilgore | 166/63 |
| 4,515,217 | 5/1985 | Stout | 166/297 |
| 4,526,233 | 7/1985 | Stout | 166/377 |
| 4,765,409 | 8/1988 | McClure et al. | 166/297 |
| 4,771,827 | 9/1988 | Barker et al. | 166/55.1 |
| 4,776,393 | 10/1988 | Forehand et al. | 166/55.1 |
| 4,815,540 | 3/1989 | Wallbillich, III | 166/377 |
| 4,905,759 | 3/1990 | Wesson et al. | 166/377 X |

OTHER PUBLICATIONS

P. B-4 from Vann Systems catalogue, entitled "Mechanical Release Firer (MRF)," wherein, the releasing device will drop the guns when the guns detonate.

A drawing entitled "3⅜" Gun Drop Firing Head," wherein, the collet moves off a shoulder when a piston moves in response to detonation of a perforating gun; no frangible tube is disclosed here.

One page from an NL McCullough catalogue, disclosing "Mechanical Firing Head with Automatic Release," wherein, following detonation, bottom hole pressure forces a release sleeve upwardly thereby allowing collets to collapse and release the gun.

(List continued on next page.)

*Primary Examiner*—Hoang C. Dang

*Attorney, Agent, or Firm*—Henry N. Garrana; John H. Bouchard

[57] ABSTRACT

An automatic tubing release mechanism is adapted to be disposed in a wellbore between a tubing, on one end, and a perforating gun, on the other end. The release mechanism includes a frangible breakup tube, firing head positioned above the breakup tube, and the perforating gun positioned below the breakup tube when the release mechanism is disposed in the wellbore. A detonating cord is interconnected between the firing head and the perforating gun via the breakup tube. When the firing head detonates the perforating gun, the breakup tube shatters. When the breakup tube shatters: in accordance with one embodiment, a release piston, previously resting on the breakup tube, moves downwardly in response to hydrostatic pressure of wellbore fluid and releases a collet arm which rests against a threaded connection of a housing, the release of the collet arm disconnecting the perforating gun from the tubing, the perforating gun falling to a bottom of the wellbore; or, in accordance with another embodiment, wellbore fluid at hydrostatic pressure enters a plurality of fluid ports and exerts a pressure on an underside of a release piston causing the piston to move upwardly thereby releasing a collet arm which rests against a threaded connection of a housing, the release of the collet arm disconnecting the perforating gun from the tubing, the perforating gun falling to a bottom of the wellbore.

26 Claims, 8 Drawing Sheets

OTHER PUBLICATIONS

Two pages from Schlumberger Maintenance Manual, entitled "Automatic Gun Release Firing Head," wherein, pressure builds shearing shear pins releasing the gun.

One page from a brochure of Baker Sand Control Perforating Systems related to and entitled "Gun Releases," illustrating Mechanical Gun Release Sub, Hydraulic Gun Release Sub, and Automatic-Release Mechanical Firing Head.

One page from a brochure of Compac, entitled "Automatic Disconnect," wherein pressure from detonation of explosive train shifts the piston and releases the collet fingers allowing the guns to drop.

Two pages from Vann Systems catalogue, entitled "Automatic Release (AR)," wherein, the gun is released when it detonates.

| |
|---|
| FIG. 2 |
| FIG. 5 |

FIG.10a
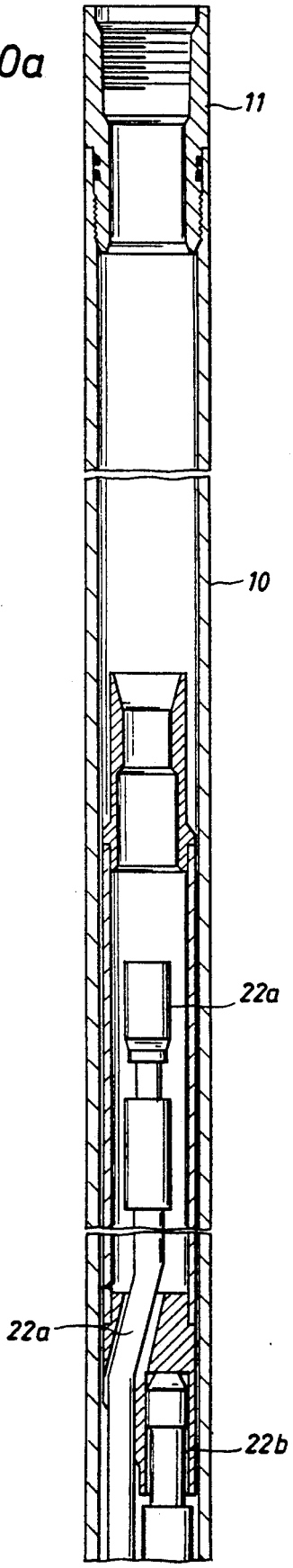
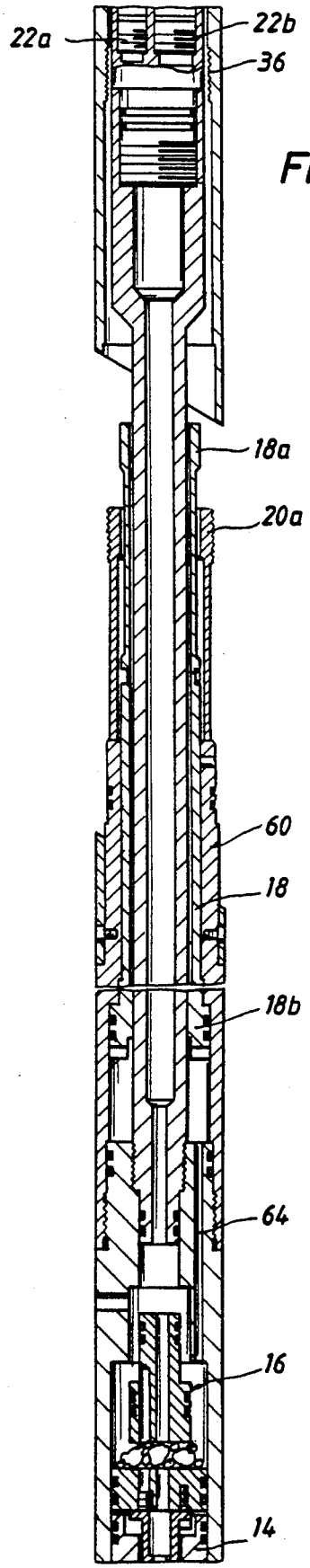
FIG.10b

AUTOMATIC TUBING RELEASE

This is a continuation of application Ser. No. 07/858,400, filed Mar. 26, 1992, now abandoned.

BACKGROUND OF THE INVENTION

The subject matter of the present invention relates to a release mechanism associated with a perforating apparatus adapted to be disposed in a wellbore, and more particularly, to an automatic tubing release mechanism connected between a perforating apparatus and a tubing for shattering a frangible breakup tube thereby automatically releasing the perforating apparatus from the tubing in response to a detonation was passing. Throw in the break-up tube.

It is sometimes desirable when perforating a wellbore to automatically disconnect a perforating gun from a tubing in response to a detonation of the perforating gun and drop the perforating gun to a bottom of the wellbore. This is especially true in permanent completions where no additional wireline or tubing runs are desired. It is also desirable to automatically disconnect the perforating gun from the tubing following detonation when perforating in certain specific formations where, following detonation, an inflow of formation fluids will cause the perforating gun string to sand up and become stuck in the casing. Many automatic releases are presently available from various manufacturers. Such releases usually use the detonation of the firing head or detonating cord to trigger the release. Many utilize the hydrostatic fluids, entering through the open holes of a spent or expired perforating gun, to shift a piston or a sleeve and to unlock and separate the perforating gun from the end of a tubing. For example, U.S. Pat. No. 4,526,233 to Stout discloses a releasable coupling for tubing conveyed perforating guns wherein a pressurized fluid resultant from detonation of the perforating gun shifts an annular piston thereby unlatching a radially shiftable latch means from one position to another position and allowing the perforating gun to separate from the tubing. In addition, U.S. Pat. No. 4,815,540 to Wallbillich discloses a method and apparatus for releasing a well perforating gun from a supporting tubing wherein a fluid pressure in an annular fluid pressure chamber supplied from the tubing string shearably releases a piston causing the piston to move out of engagement with collet locking heads thereby allowing the collet heads to shift radially to clear a downwardly facing annular surface and releasing the perforating gun form the tubing, the gun falling to a bottom of the wellbore.

One problem with many of these prior releases results form a pressure leak in the gun; if a gun leaks pressure form the wellbore to the inside of the gun string, this pressure may prematurely activate the release and separate the guns from the end of the tubing Another problem with these prior releases involves clogged or plugged shaped charge holes; when heavy muds exist in the wellbore, the shot shaped charge holes in the perforating gun can become plugged with charge debris and mud, thereby preventing adequate fluid pressure form shifting the release piston.

SUMMARY OF THE INVENTION

Accordingly, it is a primary object of the present invention to overcome the problems associated with prior art release mechanisms, which release mechanisms are designed to disconnect a perforating gun from a tubing following detonation of the perforating gun.

It is a further object of the present invention to design and provide a release mechanism adapted to be connected between a tubing and a perforating gun which includes a frangible breakup tube that is designed to shatter in response to detonation wave passing there through, the release mechanism disconnecting the perforating gun from the tubing when the breakup tube shatters. It is a further object of the present invention to provide the release mechanism including the frangible breakup tube, the tube shattering in response to a detonation wave passing therethrough, a piston moving downwardly in the release mechanism when the tube shatters, a collet finger moving off a threaded connection when the piston moves down, the release mechanism disconnecting the perforating gun from the tubing when the collet finger moves off the threaded connection.

It is a further object of the present invention to provide the release mechanism including the frangible breakup tube, the tube shattering in response to detonation wave passing therethrough and opening fluid passages, a piston moving upwardly in the release mechanism when the tube shatters and the fluid passages open, a collet finger moving off a threaded connection when the piston moves upwardly, the release mechanism disconnecting the perforating gun from the tubing when the collet finger moves off the threaded connection.

In accordance with these and other objects of the present invention, an automatic tubing release mechanism is adapted to be disposed between a tubing, on one end, and a perforating gun, on the other end, in a wellbore. The release mechanism includes a frangible breakup tube, a firing head positioned above the breakup tube, and the perforating gun positioned below the breakup tube when the release mechanism is disposed in the wellbore. A detonating cord denoted for conducting a detonation wave, is interconnected between the firing head and the perforating gun via the breakup tube. When the detonation wave passes through the frangible breakup tube, the breakup tube shatters. When the breakup tube shatters, either of two things can happen: (1) in accordance with one embodiment of invention, a release piston, previously resting on the breakup tube, moves downwardly in response to hydrostatic pressure of wellbore fluid and releases a collet arm which rests against a threaded connection of a housing, the release of the collet arm disconnecting the perforating gun from the tubing, the perforating gun falling to a bottom of the wellbore; and (2) in accordance with another embodiment of the invention, wellbore fluid at hydrostatic pressure enters a plurality of fluid ports and exerts a pressure on an underside of a release piston causing the piston to move upwardly thereby releasing a collet arm which rests against a threaded connection of a housing, the release of the collet arm disconnecting the perforating gun from the tubing, the perforating gun falling to a bottom of the wellbore.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 8a–8b, 9a–9b, and 10a–10b illustrate a functional operation of the automatic tubing release mechanism shown in FIGS. 6a–7.

DETAILED DESCRIPTION OF THE PREFERRED EMBODIMENT

Figure 1A:
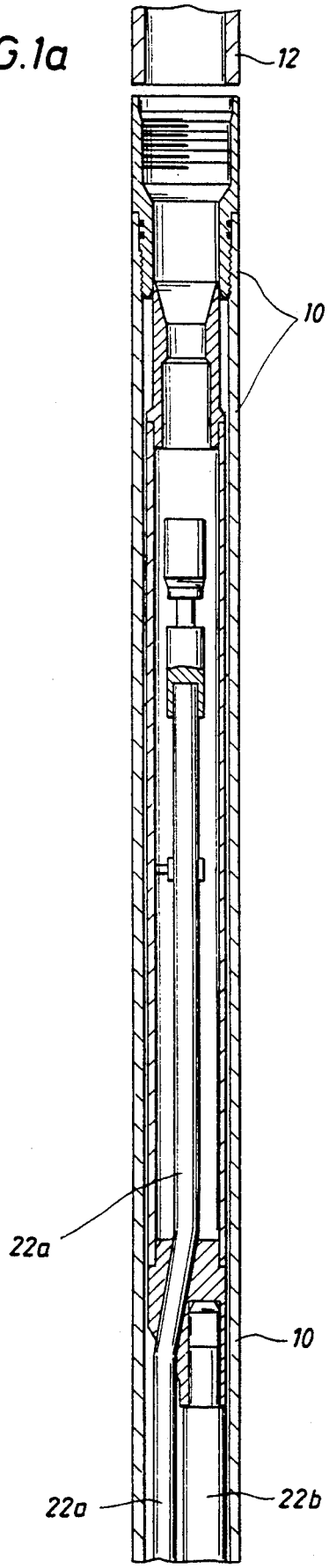
FIG. 1a–1b illustrates a wellbore apparatus including a first sub or fill sub adapted to be connected to a tubing, a second sub adapted to be connected to a perforating gun apparatus, and an automatic tubing release mechanism, including a frangible breakup tube, disposed between the first sub and the second sub for disconnecting the second sub including the perforating gun from the first (fill) sub and the tubing when the frangible breakup tube shatters.
Figure 1B:
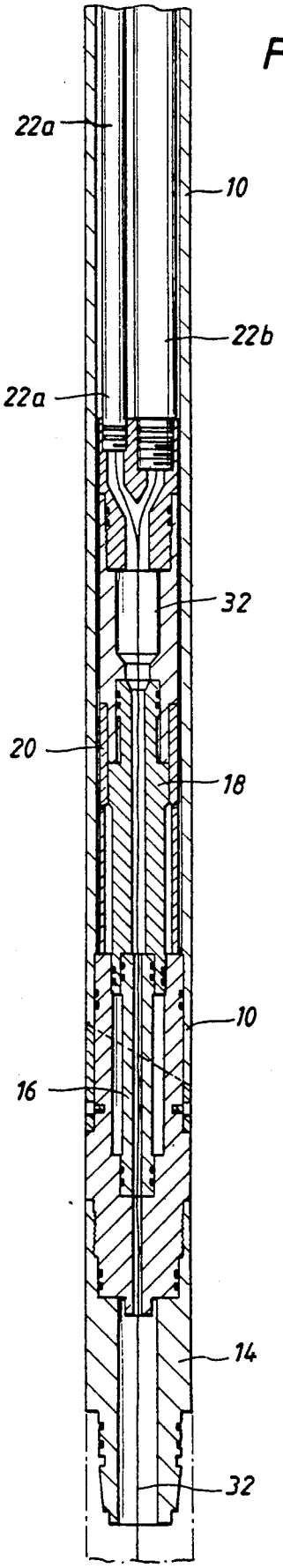

Referring to FIGS. 1a–1b, a wellbore apparatus, including the automatic tubing release mechanism of the present invention, is illustrated.

In FIGS. 1a and 1b, a first sub or fill sub 10 is adapted to be connected to a tubing 12. A second sub 14 is adapted to be connected to a perforating gun apparatus. An automatic tubing release mechanism (including a frangible breakup tube 16, a release piston 18, collet fingers 20, and a pair of firing heads 22a and 22b) is adapted to be disposed within the fill sub 10 and is connected to the second sub 14. In operation, when a detonation wave from one of the firing heads 22a or 22b passes through the frangible breakup tube 16, the frangible breakup tube 16 shatters; and, when the breakup tube 16 shatters, the automatic tubing release mechanism disconnects the second sub 14, including the attached perforating gun, from the first (fill) sub 10 and allows the perforating gun, second sub 14, release piston 18, collet fingers 20 and firing heads 22a and 22b to withdraw from within the fill sub 10 and away from the tubing 12.

Referring to FIGS. 2–5, a more detailed construction of the automatic tubing release mechanism of FIGS. 1a–1bis illustrated.

Figure 2:
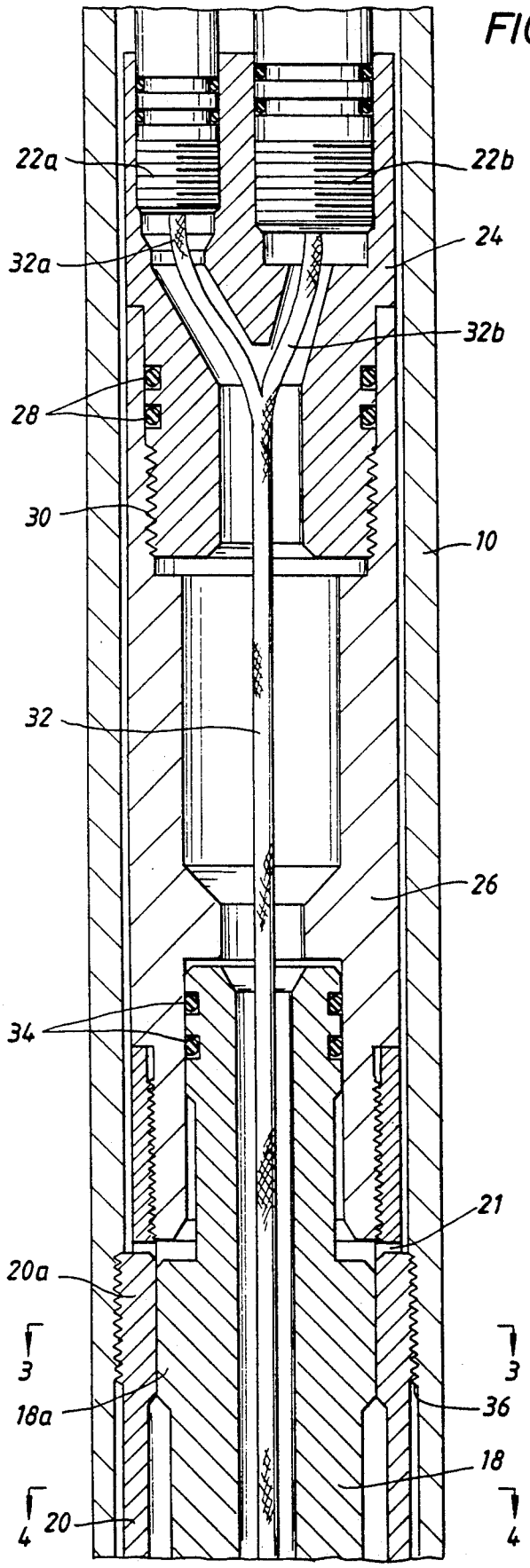
FIGS. 2–5 illustrate one embodiment of the automatic tubing release mechanism.

In FIG. 2, the fill sub 10 is adapted to be connected to the tubing 12 of FIG. 1, disposed on one side of the automatic tubing release mechanism, and encloses the firing heads 22a and 22b as well as the automatic tubing release mechanism of the present invention. A firing head adaptor 24 receives the firing heads 22a and 22b and is sealingly and threadedly connected to a transfer housing 26 via a pair of O-rings 28 and a threaded connection 30. A detonating cord 32 is connected to a perforating gun which is disposed on the other side of the automatic tubing release mechanism. A detonating cord 32a is connected to firing head 22a and a detonating cord 32b is connected to firing head 22b, the detonating cords 32a and 32b being joined or connected to a detonating cord 32. The detonating cord 32 passes through the center of the automatic tubing release of FIGS. 2 and 5, and extends from the firing heads 22a and 22b, on one side, to the perforating gun, on the other side.

Figure 3:
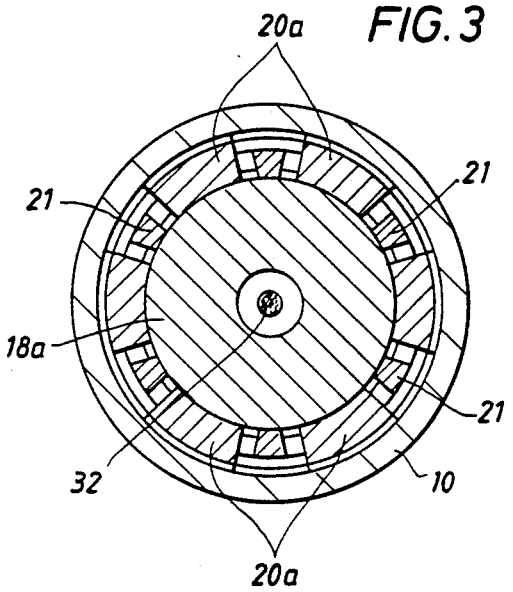
Figure 4:
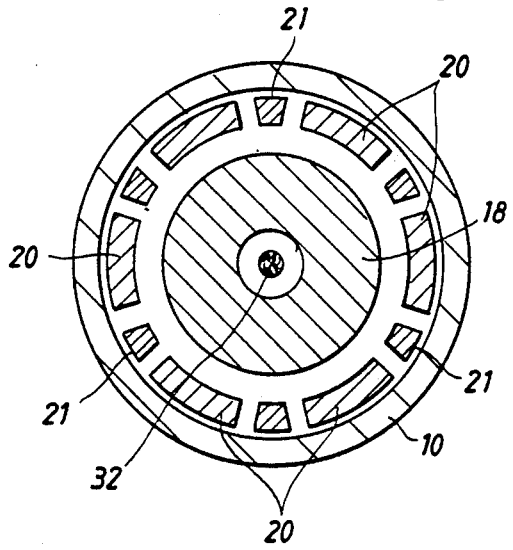
Figure 5:
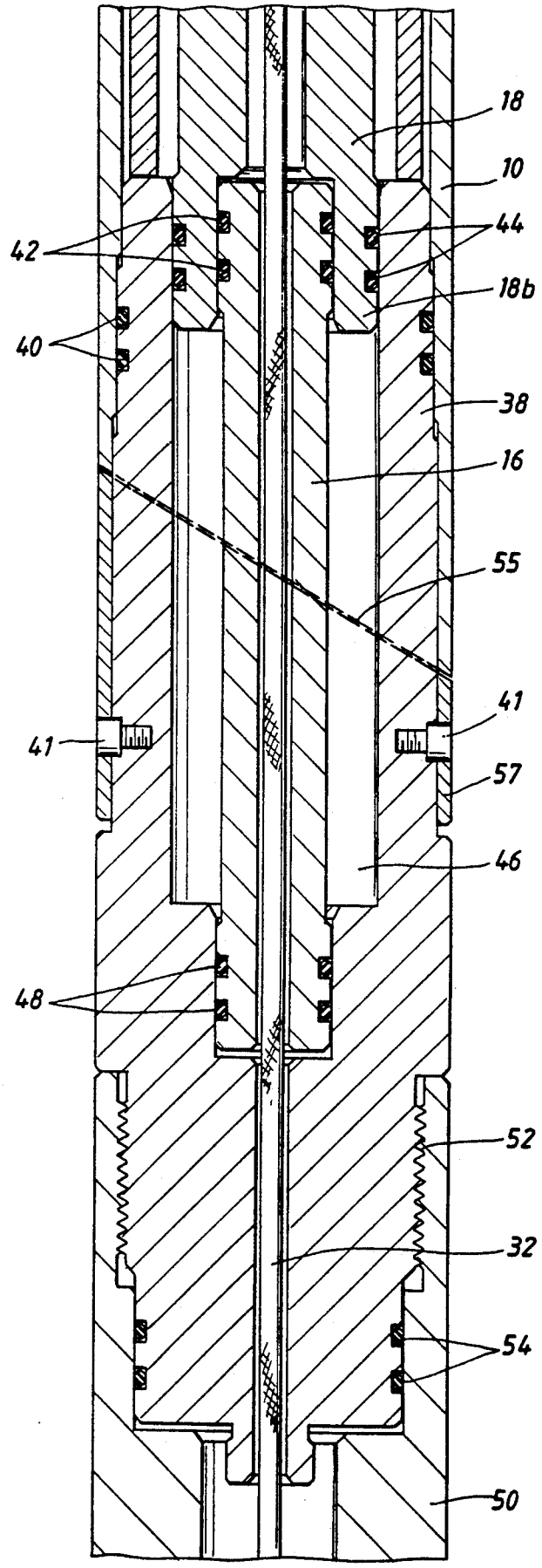

The automatic tubing release mechanism of the present invention comprises: in FIG. 2, a release piston 18 sealingly connected to the transfer housing 26 via a pair of O-rings 34, the release piston 18 having a protruded portion or locking upset 18a; collet fingers 20 each having an end 20a which is adapted to contact the locking upset 18a of the release piston 18, on one side, and adapted to contact a threaded connection 36 disposed on an internal periphery of the fill sub 10, on the other side, when the end 20a contacts the locking upset 18a, the collet fingers 20 being ultimately threadedly connected to the transfer housing 26 via the upper end of release mandrel 38 and intermediate pieces 21 disposed between adjacent collet fingers 20, the intermediate pieces 21 being shown in FIGS. 2, 3 and 4; in FIG. 5, a release mandrel 38 is integrally connected to the collet fingers 20 and is sealed against the fill sub 10 via a pair of O-rings 40; locking screws 41 secure an anti-rotation lock 57 to release mandrel 38, the antirotation lock 57 preventing the release mandrel 38 from rotating relative to the fill sub 10; a frangible breakup tube 16, comprised of a ductile iron, is sealingly connected to the release piston 18, one end 18b of the release piston 18 being sealingly disposed between one end of the frangible breakup tube 16 and the release mandrel 38 via pairs of O-rings 42 and 44, the other end of the frangible breakup tube 16 being sealingly disposed against the release mandrel 38 via a further pair of O-rings 48; an air chamber 46 is formed between the release mandrel 38 and the frangible breakup tube 16; and a bottom sub or gun adaptor 50 is threadedly and sealing connected to the release mandrel 38 via threads 52 and a pair of O-rings 54, the second sub 14, which is attached to a perforating gun, being connected to the bottom sub 50.

In FIG. 5, a wireline re-entry guide 55 represents the actual shape of the end of the production tubing or fill sub 10. It is sometimes called a 'muleshoe' and is shaped at an angle, having an internal bevel. It provides for easy re-entry of wireline tools into the tubing after the tools have run out of the end of the tubing. The purpose of guide 55 is to reduce the chance of hanging up wireline tools when re-entering tubing.

FIG. 3 illustrates the ends 20a (of collet fingers 20) when viewed in a cross section taken along section lines 3—3 of FIG. 2.

FIG. 4 illustrates the collet fingers 20 when viewed in a cross section taken along section lines 4–4 of FIG. 2.

A functional description of the operation of the automatic tubing release mechanism of the present invention will be set forth below with reference to FIGS. 1–5 of the drawings.

The automatic tubing release mechanism of FIGS. 2 and 5 is attached to a perforating gun, on its lower end, and to a tubing, on its upper end, and is lowered into a wellbore to perforating depth. Other perforating accessories, such as a packer, may be placed above the automatic tubing release mechanism in the wellbore. Wellbore fluid enters the fill sub 10 and surrounds the firing heads 22a and 22b and release piston 18. Hydrostatic pressure tends to force the release piston 18 downwardly into the air chamber 46, which chamber 46 is sealably formed, at one end, by the lower end of the release piston 18, which has a cross sectional area of "A2", and the inside portion of the release mandrel 38. The upper end of the release piston 18 has a cross section area of "A1". The release piston 18 is forced downwardly by a force which is equal to the area (A2−A1) times the hydrostatic pressure. However, the release piston 18 cannot move downwardly because the frangible breakup tube 16 rigidly positions the piston 18 in place by abutting against the bottom of piston 18, on one end, and against a shoulder inside the release mandrel 38, on the other end. The downward pressure force induced on the release piston 18 induces a downward compressive force on the frangible breakup tube 16. The frangible breakup tube 16 is designed to be stronger than any compressive force that can be induced by the release piston 18. Therefore, the release piston 18 is rigidly held in position by the frangible breakup tube 16, and the locking upset 18*a* of release piston 18 is positioned underneath the end 20*a* of collet finger 20; as a result, the collet fingers 20 are prevented from collapsing, and the automatic tubing release mechanism is locked to the fill sub 10. A fluid leak in the gun string prior to initiating the firing heads 22*a* and 22*b* cannot move the release piston 18 and prematurely release the perforating gun from the tubing 12 because the frangible breakup tube 16 rigidly prevents the release piston 18 from moving.

However, when the firing heads 22*a* and 22*b* are initiated, a detonation wave is initiated within the detonating cord 32, the detonation wave propagating from the firing heads 22*a* and 22*b*, through firing head adaptor 24, transfer housing 26, release piston 18, frangible breakup tube 16, release mandrel 38, bottom sub 50 and second sub 14, shooting the perforating gun. When the detonation wave propagating in the detonating cord 32 passes through the frangible breakup tube 16, the resultant shock wave and pressure from the detonation wave shatters the frangible breakup tube 16 (recall) that the frangible breakup tube 16 is made of ductile iron; this material shatters in response to the shock wave from under the wave in the detonating cord 32). The breakup tube 16 shatters into small pieces. As a result, the release piston 18 is no longer supported and held in position by the breakup tube 16. The pressure force pushing down on the release piston 18 forces the piston 18 down into the air chamber 46. The locking upset 18*a* on the release piston 18 moves out from under the end 20*a* of the collet fingers 20. The weight of the perforating guns connected to the bottom sub 50 via second sub 14, which is now contacting only the threaded connection 36 on fill sub 10, causes the collet fingers 20 to collapse inwardly thereby disengaging the release mandrel 38 from the fill sub 10 (the collet fingers 20 collapse inwardly due to the angle of the threads on the inside of the fill sub 10 and the mating threads on the outside of the collet fingers 20). When the release mandrel 38 is disengaged from the fill sub 10, the following equipment falls to the bottom of the wellbore: the perforating gun, second sub 14, bottom sub 50, release mandrel 38, collet fingers 20, release piston 18, transfer housing 26, and firing heads 22*a* and 22*b*.

Figure 6A:
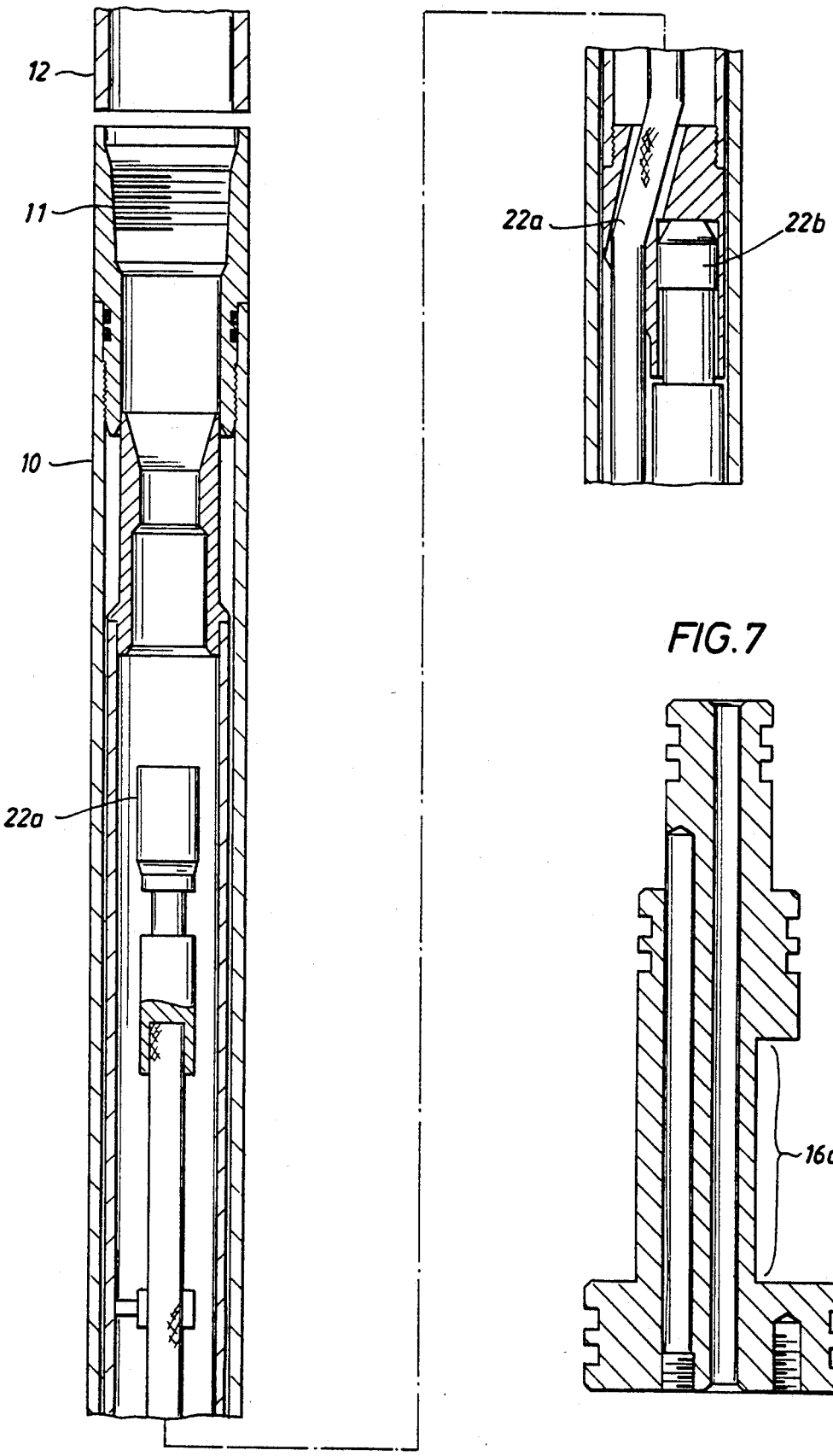
FIGS. 6a, 6b, and 7 illustrate another embodiment of the automatic tubing release mechanism.
Figure 7:
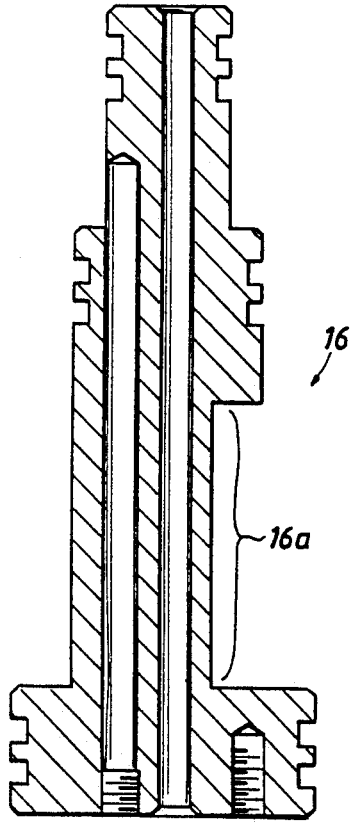
Figure 6B:
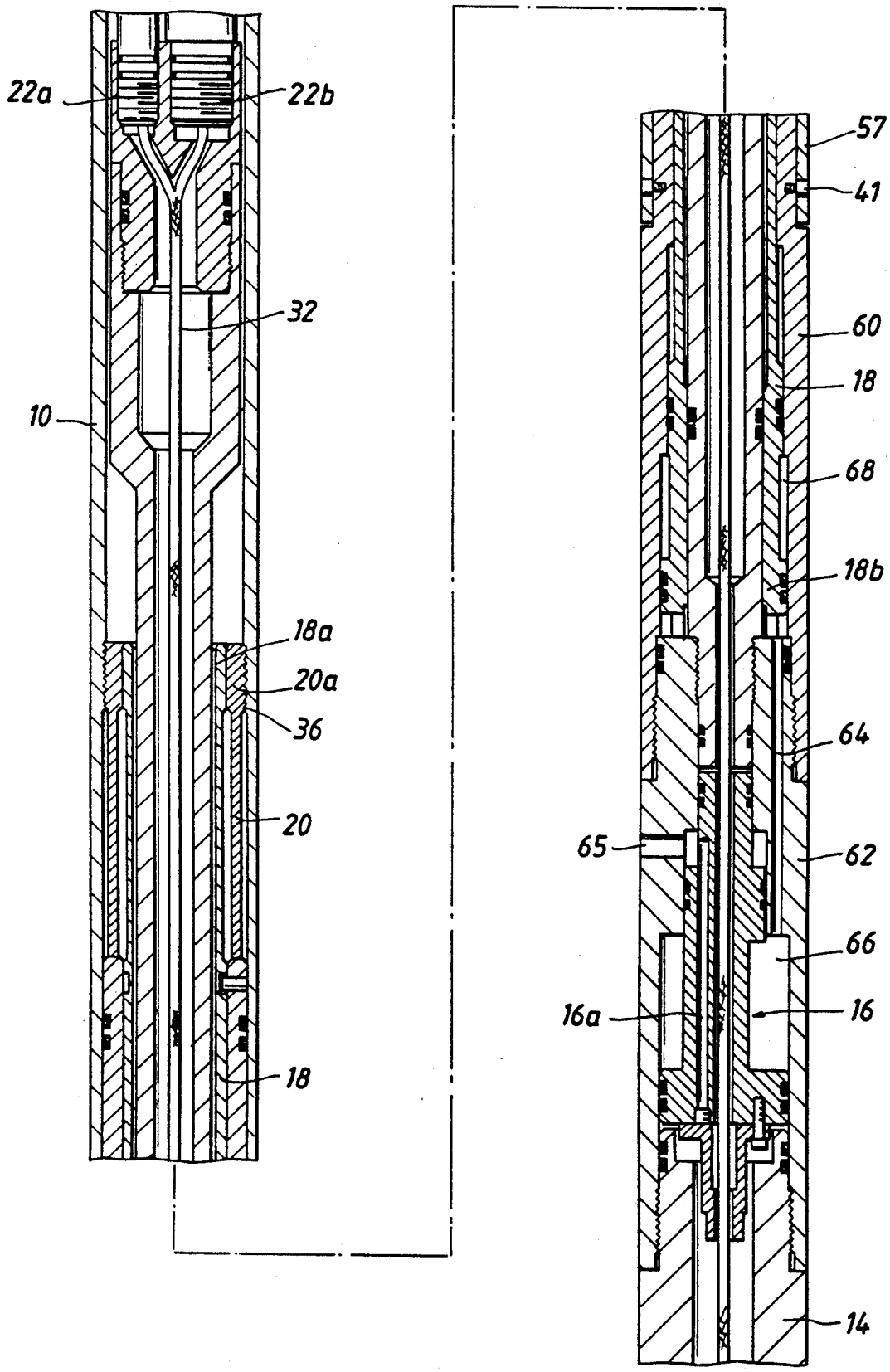

Referring initially to FIGS. 6*a*–6*b* and 7 during the structural description, and subsequently to FIGS. 8*a*–10*b* during the functional description, another embodiment of the automatic tubing release mechanism of the present invention is illustrated.

In FIGS. 6*a*–6*b*, as before, a fill sub 10 in FIG. 6*a* is adapted to be connected to a tubing 12 via a top sub 11 and, as illustrated in FIG. 6*b*, includes a threaded connection 36 which is adapted to abut against the end associated with a plurality of collet fingers (discussed more fully below), the fill sub 10 enclosing the firing heads 22*a* and 22*b*, the associated detonating cord 32, and the automatic tubing release mechanism in accordance with this embodiment of the present invention.

The automatic tubing release mechanism of this embodiment comprises: in FIG. 6*b*, a release housing 60 is sealingly secured to the fill sub 10 and is connected to fill sub 10 via a plurality of collapsible collet fingers 20, each having an end 20*a*, integrally connected to the release housing 60, the ends 20*a* abutting against the threaded connection 36 of the fill sub 10, similar to that shown in the FIGS. 2 and 5 embodiment; screws 41 secure an antirotation lock 57 to release housing 60, the antirotation lock 57 preventing the release housing 60 from rotating relative to fill sub 10; a breakup plug housing 62 is threadedly and sealingly connected to the release housing 60, the breakup plug housing 62 including a release piston 18 integrally connected thereto, the release piston 18 having a locking upset 18*a* disposed at its end, which locking upset 18*a* is adapted to abut against the ends 20*a* of a plurality of the collet fingers 20 of release housing 60 thereby ensuring said ends 20*a* are firmly in abutment against threaded connection 36 and further ensuring that the automatic tubing release mechanism remains connected to the fill sub 10 and to the tubing 12; the breakup plug housing 62 further includes a fluid port 64 and a hydrostatic pressure port 65, the hydrostatic pressure port 65 fluidly communicating the hydrostatic pressure of the wellbore fluid with a frangible breakup plug 16 discussed below, the fluid port 64 being disposed longitudinally through the breakup plug housing 62 and fluidly communicating one end 18*b* of release piston 18 with a second air chamber 66, a first air chamber 68 being disposed between release piston 18 and the release housing 60; in FIGS. 6*b*, and 7, a frangible breakup plug 16 is sealingly connected to and is enclosed within the breakup plug housing 62, the breakup plug 16 including a neck section 16*a* which is easily shatterable in response to detonation of the detonating cord, the neck section 16*a* being easily shatterable primarily due to the unique material of which the neck section 16*a* is comprised, that is, a ductile iron.

A functional description of the operation of the automatic tubing release mechanism of this embodiment of the present invention will be set forth in the following paragraphs with reference to FIGS. 8*a*–10*b* of the drawings.

Figure 8A:
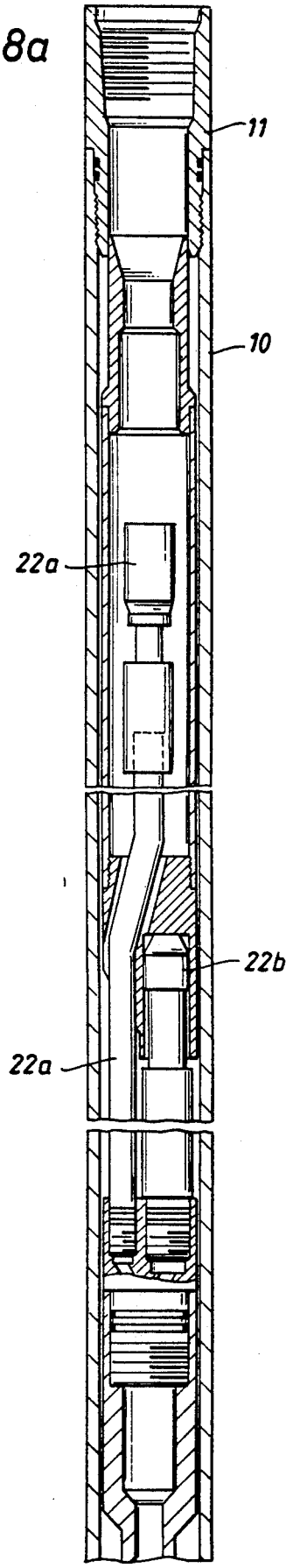
Figure 8B:
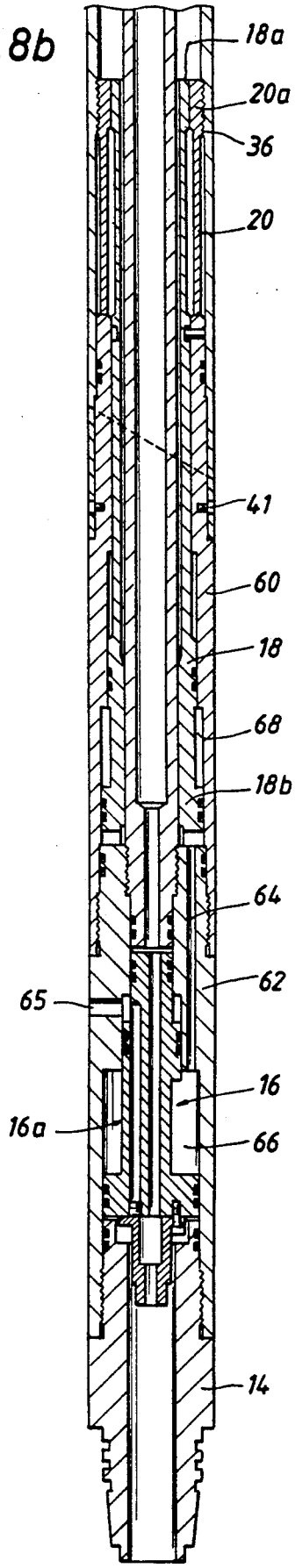
Figure 9A:
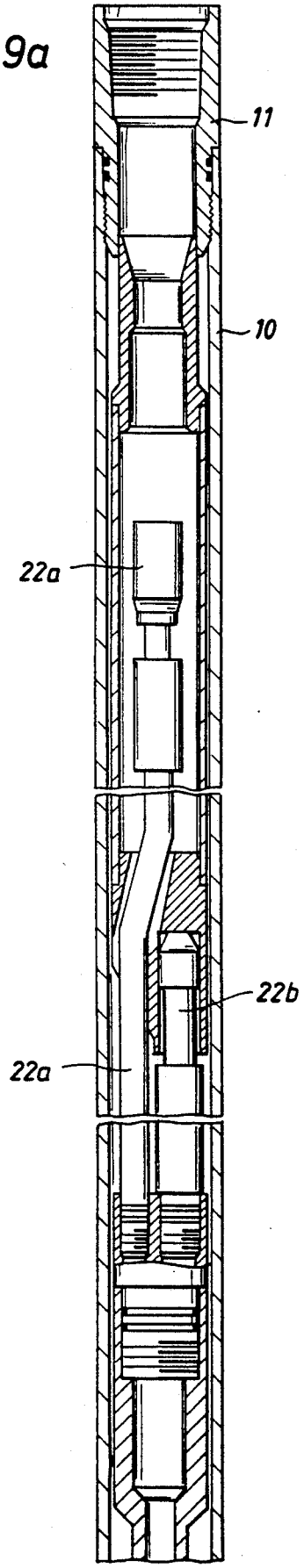
Figure 9B:
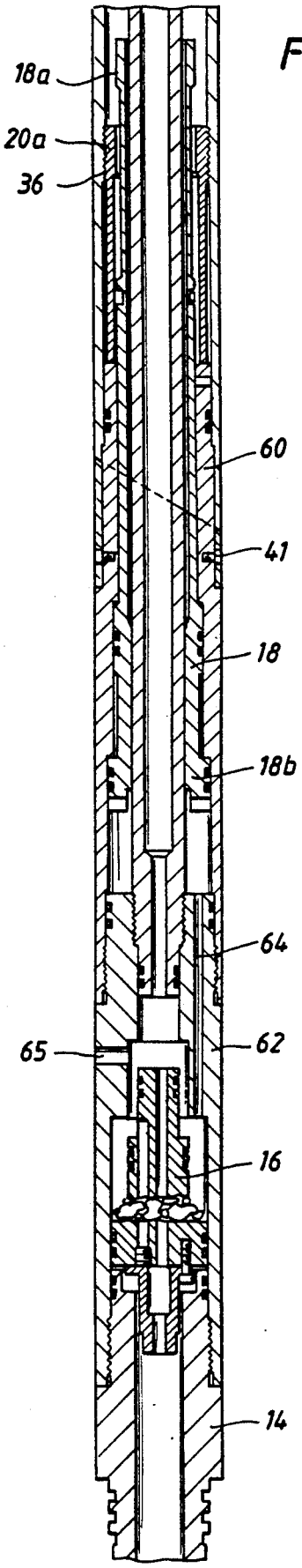

The automatic tubing release mechanism of FIGS. 8*a*–8*b* is attached to a perforating gun, on its lower end, and to a tubing, on its upper end, and is lowered into a wellbore to perforating depth. Other perforating accessories, such as a packer, may be placed above the automatic tubing release mechanism in the wellbore. Wellbore fluid under hydrostatic pressure enters the hydrostatic pressure port 65 of FIG. 6*b* in the breakup plug housing 62. This wellbore fluid pressure exerts a downward compressive force on the milled out section, the neck section 16*a*, of the breakup plug 16. This wellbore fluid pressure cannot communicate with the second air chamber 66 or with the fluid ports 64; therefore, it cannot communicate with the one end 18*b* of the release piston 18. As a result, the collapsible release fingers 20 remain locked in place by the locking upset 18*a* of release piston 18 and cannot collapse. Prior to initiating the firing heads 22*a* and 22*b*, a fluid leak in the gun string cannot cause a premature actuation of the release piston, since the second air chamber 66 is sealed off from the inner diameter of the gun string by seals on the breakup plug 16 and by the neck section 16*a* of the plug 16.

When the firing heads 22*a* and 22*b* are initiated, a detonation wave is initiated in the detonating cord 32. Since the detonating cord 32 passes through the frangible breakup plug 16, the detonation wave propagates through the breakup plug 16 and detonates the perforation gun. When the detonation wave in detonating cord 32 passes through the neck section 16*a* of the frangible breakup tube 16, the shock wave and pressure from the detonation wave shatters the neck section 16*a* of the frangible breakup plug 16. When the neck section 16*a* shatters, the wellbore fluid under hydrostatic pressure, entering the hydrostatic pressure port 65, is allowed to enter the second air chamber 66 and the fluid ports 64. As a result, the wellbore fluid, having entered the fluid ports 64, exerts the hydrostatic pressure on the one end 18*b* of the release piston 18. As noted in FIG. 9*b*, the release piston 18 is forced upwardly against the first air chamber 68, a shear screw is sheared, and the locking upset 18*a* on the end of the release piston 18 moves out from under the ends 20*a* of the collet fingers 20. The weight of the perforating guns provide a force on the collet fingers 20 causing them to collapse inwardly and off threaded connection 36. As noted in FIG. 10*b*, when the collet fingers 20 collapse inwardly and off threaded connection 36, the perforating gun, second sub 14, breakup plug housing 62, release housing 60, release piston 18, collet fingers 20 and firing heads 22*a* and 22*b* all fall to the bottom of the wellbore. The perforating gun can be fished out of the wellbore at a later date.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Release apparatus adapted to be connected between a perforating apparatus and a tubing for releasing the perforation apparatus from the tubing, comprising:

a frangible breakup apparatus including a hollow interior;

a detonating cord adapted for conducting a detonation wave disposed within said hollow interior of said frangible breakup apparatus and connected to said perforating apparatus, said frangible breakup apparatus shattering in response to said detonation wave conducting in said detonating cord; and connection means for maintaining a connection between the perforating apparatus and the tubing before the frangible breakup apparatus shatters and disengaging said connection between the perforating apparatus and the tubing after the frangible breakup apparatus shatters.

2. The release apparatus of claim 1, wherein said connection means comprises:

a housing having an apparatus;

an axially shiftable release piston adapted for axially shifting into and out of alignment with said apparatus of said housing; and collet means connected to said perforating apparatus and disposed between said release piston and the apparatus of said housing for contacting said apparatus of said housing when said release piston is axially shifted into alignment with said apparatus of said housing, said perforating apparatus being connected to said tubing when said collet means contacts said apparatus of said housing, said collet means being disengaged from said apparatus of said housing when said frangible breakup apparatus shatters and said release piston is axially shifted out of alignment with said apparatus of said housing, said perforating apparatus being disconnected from said tubing when said collet means is disengaged from said apparatus of said housing.

3. The release apparatus of claim 2, wherein said frangible breakup apparatus prevents said axially shiftable release piston from shifting out of alignment with said apparatus of said housing before said frangible breakup apparatus shatters.

4. The release apparatus of claim 3, wherein said frangible breakup apparatus si comprised of a material which is adapted to shatter when said detonation wave conducting in said detonating cord passes through said frangible breakup apparatus.

5. The release apparatus of claim 4, wherein said material comprises ductile iron.

6. The release apparatus of claim 3, wherein said axially shiftable release piston shifts out of alignment with said apparatus of said housing after said frangible breakup apparatus shatters, said perforating apparatus being released from said tubing after said axially shiftable release piston shifts out of alignment with said apparatus of said housing.

7. A method of automatically releasing a perforating apparatus from a tubing, comprising the steps of:

conducting a detonation wave through a detonating cord, said detonating cord begin disposed within an interior of a frangible member and connected to said perforating apparatus;

directing the propagation of said detonation wave initially through said interior of said frangible member and subsequently toward said perforating apparatus;

shattering said frangible member in response to said detonation wave conducting through said detonating cord; and releasing said perforating apparatus from said tubing only after said frangible member shatters.

8. The method of claim 7, wherein a collet finger connected to said perforating apparatus is initially disposed between and in contact with an axially shiftable release piston and an apparatus of a housing connected to said tubing, the releasing step comprising the steps of:

axially shifting said release piston to another position when said frangible member shatters, said piston moving out of contact with said collet finger when said piston axially shifts to said another position; and disengaging said collet finger form said apparatus of said housing when said piston moves out of contact with said collet finger, said perforating apparatus being released from said tubing when the collet finger is disengaged forms aid apparatus of said housing.

9. Apparatus for controlling the movement of a piston in a well tool in the presence of a hydrostatic pressure of a wellbore fluid when said well tool is disposed in a wellbore and for disconnecting a perforating apparatus from a tubing in response to said movement, comprising:

frangible means including a hollow interior for preventing said wellbore fluid from exerting said hydrostatic pressure on said piston, said piston not moving and remaining stationary when said wellbore fluid is not exerting said hydrostatic pressure on said piston; and means for shattering said frangible means, said wellbore fluid exerting said hydrostatic pressure on said piston when said frangible means shatters, said piston moving in response to said hydrostatic pressure, said perforating apparatus being disconnected from said tubing in response to the movement of said piston, the means for shattering said frangible means including a detonating cord adapted for conducting a detonation wave disposed within said hollow interior of said frangible means, said frangible mean shattering in response to said detonation wave conducting within said detonating cord and propagating within the hollow interior of said frangible means.

10. The apparatus of claim 9, wherein said frangible means comprises a frangible tube adapted for preventing said wellbore fluid form exerting said hydrostatic pressure on said piston before said frangible tube is shattered.

11. The apparatus of claim 10, wherein said frangible tube is comprised of ductile iron.

12. A release apparatus adapted to be connected between a perforating apparatus and a tubing for releasing the perforating apparatus from the tubing, comprising:

means for connecting said perforating apparatus to said tubing;

frangible means having a hollow center ad adapted to shatter for maintaining the connection between the perforating apparatus and the tubing by said means for connecting when the frangible means remains intact and has not shattered; and detonating cord means disposed within the hollow center of said frangible means and connected to said perforating apparatus for conducting a detonation wave through said frangible means and toward said perforating apparatus.

said frangible means shattering in response to said detonation wave conducting within said detonating cord means, said perforating apparatus detonating in response to said detonation wave, said perforating apparatus being released form said tubing when said frangible means shatters.

13. The release apparatus of claim 12, wherein the frangible means shatters when the detonation wave conducting within the detonating cord means passes through said frangible means.

14. The release apparatus of claim 12, wherein said means for connecting comprises:

a collet finger;

an engagement apparatus disposed on an internal surface of said tubing and adapted to engage with said collet finger; and an axially shiftable release piston adapted to firmly engage said collet finger against said engagement apparatus of said tubing when the release piston is axially shifted to a first position, the perforating apparatus being connected to said tubing when said release piton is axially shifted to said first position and firmly engages said collet finger against said engagement apparatus of said tubing.

15. The release apparatus of claim 14, wherein said frangible means prevents said release piston from axially shifting away form said first position when said frangible means remains intact and has not shattered.

16. The release apparatus of claim 15, wherein said release piston axially shifts away form said first position to a second position when said frangible means shatters in response to said detonation wave conducting within said detonating cord means, said perforating apparatus being released from said tubing when said release piston shifts to said second position.

17. The release apparatus of claim 16, wherein said frangible means is a tube comprised of a ductile iron, an interior of said tube being said hollow center, said detonating cord means being disposed within the interior of said tube, said tube shattering in response to the detonation wave propagating within said detonating cord means.

18. A method of releasing a perforating apparatus form a tubing, comprising the steps of:

conducting a detonation wave in a detonating cord and propagating said detonation wave through an interior of a frangible member;

shattering said frangible member when the detonation wave in said detonating cord passes through said frangible member;

shifting a release piston in release piston in response to the shattering step; and releasing the perforating apparatus from the tubing in response to the shifting step.

19. The method of claim 18, wherein the releasing step further comprises the steps of:

radially moving a collet finger away form an internal surface of said tubing in response to the shifting step; and releasing the perforating apparatus form the tubing in response to the moving step.

20. Release apparatus adapted to be connected between a device and a tubing in a wellbore for releasing the device form the tubing, comprising:

a frangible apparatus having a hollow interior, said frangible apparatus being comprised of a cast iron material;

detonating cord means disposed with the hollow interior of said frangible apparatus for conducting a detonation wave, said detonation wave shattering the cast iron material of said frangible apparatus when said detonation wave conducts through said frangible apparatus; and connection means for maintaining a connection between the device and the tubing before the frangible apparatus shatters and disengaging said connection between the device and the tubing after the frangible apparatus shatters.

21. The release apparatus of claim 10, wherein said frangible apparatus comprises a tube having a hollow interior, said detonating cord passing through the hollow interior of said tube.

22. The release apparatus of claim 20, wherein said device is a perforating apparatus.

23. A method of releasing a device form a tubing in a wellbore, comprising the steps of:

conducting a detonation wave in a detonating cord through an interior of a frangible member, said frangible member being comprised of a cast iron material;

shattering the cast iron material of said frangible member when the detonation wave conducts through the interior of said frangible member; and releasing the device form the tubing in response to the shattering step.

24. The method of claim 23, wherein said frangible member is a tube comprised of said cast iron material, said detonating cord passing through an interior of said tube.

25. The method of claim 23, wherein the releasing step comprises the steps of:

shifting a release piston when said frangible member is shattered in response to the detonation wave propagating through the frangible member; and releasing the device form the tubing in response to the shifting step.

26. A method of releasing a device from a tubing in a wellbore, comprising the steps of:

conducting a detonation wave in a detonating cord and propagating the detonation wave through an interior of a frangible member;

shattering said frangible member when the detonation wave propagates through said interior of said frangible member;

shifting a release piston when said frangible member is shattered in response to the detonation wave propagating through the frangible member; and releasing the device from the tubing in response to the shifting step.

* * * * *

UNITED STATES PATENT AND TRADEMARK OFFICE

CERTIFICATE OF CORRECTION

PATENT NO. : 5,293,940

DATED : Mar. 15, 1994

INVENTOR(S) : Hromas et al

It is certified that error appears in the above-identified patent and that said Letters Patent is hereby corrected as shown below:

Claim 8, line 11, change "form" to -- from --.
Claim 18, line 2, change "form" to -- from --.
Claim 21, line 1, change "10" to -- 20 --.

Signed and Sealed this

Second Day of August, 1994

Bruce Lehman

*Attest:*

BRUCE LEHMAN

*Attesting Officer*

*Commissioner of Patents and Trademarks*